US006838134B2

(12) United States Patent
Takahashi et al.

(10) Patent No.: US 6,838,134 B2
(45) Date of Patent: Jan. 4, 2005

(54) RECORDING SHEET

(75) Inventors: Jun Takahashi, Kanuma (JP); Akio Ito, Kanuma (JP); Yukiko Murasawa, Kanuma (JP); Hideaki Takahashi, Kanuma (JP)

(73) Assignee: Sony Chemicals Corp., Tokyo (JP)

( * ) Notice: Subject to any disclaimer, the term of this patent is extended or adjusted under 35 U.S.C. 154(b) by 0 days.

(21) Appl. No.: 09/881,131

(22) Filed: Jun. 14, 2001

(65) Prior Publication Data

US 2002/0012777 A1 Jan. 31, 2002

(30) Foreign Application Priority Data

Jun. 14, 2000 (JP) ..... 2000-177813

(51) Int. Cl.[7] ..... B41M 5/00

(52) U.S. Cl. ..... 428/32.25; 428/32.24; 428/32.3; 428/32.38

(58) Field of Search ..... 428/32.24, 32.25, 428/32.3, 32.38, 195, 32.13, 32.19

(56) References Cited

U.S. PATENT DOCUMENTS 4,954,395 A * 9/1990 Hasegawa et al. ..... 428/32.24
5,919,559 A 7/1999 Nakano et al. ..... 428/331
5,928,990 A 7/1999 Guistina et al. ..... 503/227

FOREIGN PATENT DOCUMENTS

JP 62-280068 12/1987
JP 11-115304 4/1999 ..... B41M/5/00

OTHER PUBLICATIONS

Patent Abstract XP–002196716, Publication No. 11–115304, Publication Date Apr. 27, 1999, 2 pages.
European Search Report dated Apr. 19, 2002, 2 pages.

* cited by examiner

*Primary Examiner*—Pamela R. Schwartz
(74) *Attorney, Agent, or Firm*—Osha & May L.L.P.

(57) ABSTRACT

A recording sheet adaptable to print an image using pigment ink, on which a smear is hardly generated, is provided. A recording sheet includes an ink permeable layer prepared by adding 3–30 parts by weight of a nonionic surfactant including an amine compound as a main component to 30 parts by weight of a water-insoluble component including an inorganic filler and a binder as main components. Ink applied on such an ink permeable layer is directly absorbed into the layer in a depth direction without dispersing in a lateral direction. Therefore, any smear (banding) is hardly generated on a printed image formed on the recording sheet using ink.

8 Claims, 3 Drawing Sheets

RECORDING SHEET

BACKGROUND OF THE INVENTION

1. Field of the Invention

The present invention relates to a recording sheet to be used for recording information thereon using ink or the like. More specifically, the invention relates to a recording sheet suitable for printing information thereon by an ink jet printer when pigment ink is used.

2. Description of the Related Art

Prior recording systems have been adapted to output printers of computers, word processors, and so on. Typically, such recording systems include a wire dot recording system, a thermal coloring recording system, a thermal melting transfer recording system, a thermal sublimation transfer recording system an electrophotographic recording system, and an ink jet recording system.

Of the types listed above, the ink jet recording system has excellent features of: the capability of using a wood free paper as a recording sheet; a low printing cost; a low noise during the printing movement; a small-sized printing device; a high speed printing; and so on, compared with those of the other recording systems. In recent years, therefore, there is the increasing range of uses for the ink jet recording system.

Various kinds of the recording sheets to be used in such an ink jet recording system are proposed in the art. In FIG. 6(*a*), reference numeral 110 denotes an example of the recording sheet to be used in a typical ink jet recording system.

The recording sheet 110 includes a transparent substrate 111, an ink receptive layer 112 formed on the surface of the substrate 111, and an ink permeable layer 113 formed on the surface of the ink receptive layer 112.

In the case of performing an ink jet recording movement on the recording sheet 110, ink is discharged as a plurality of ink droplets 114 from nozzles of an ink jet printer to the surface of the ink permeable layer 113 (FIG. 6(*a*)).

The ink permeable layer 113 of the recording sheet 110 generally includes additives such as organic and inorganic fillers. If the filler particles are dispersed in the resin provided as the binder of the ink permeable layer 113, the gaps between adjacent filler particles allow the formation of a porous structure in the ink permeable layer 113.

Once the ink droplets 114 touch on the surface of the ink permeable layer 113, the ink droplets 114 permeate from the surface to the inside by passing through "holes" in the ink permeable layer 113, (i.e., the ink permeable layer 113 is porous).

The ink droplets 114 continue to permeate through the ink permeable layer 113 until reaching the ink receptive layer 112. Once the ink droplets 114 reach the ink receptive layer 112, the ink droplets 114 are absorbed by the ink receptive layer 112, forming a dot 117 of ink thereon.

The ink droplets 114 absorbed in the ink receptive layer 112 can be observed as their corresponding dots 117 from the other side of the transparent substrate 111 with respect to the ink receptive layer 112. Therefore, a set of these dots 117 can be observed as an image printed on the recording sheet 110 (FIG. 6(*b*)).

In recent years, such recording sheets 110 have been extensively used for overhead projectors and in many other applications.

Furthermore, as described in Japanese Patent Laid-Open Publication No. Sho. 62-280068, if a surfactant is added to the ink permeable layer 113, it is possible to increase the ink permeability of the ink permeable layer 113 with respect to ink that uses a dye ("the dye ink") as a colorant.

However, if pigment ink is used instead of the dye ink, a similar effect does not occur. In the pigment ink, pigments exist as dispersed particles in the ink. In the dye ink, on the other hand, the dye is completely dissolved in the ink. Therefore, the pigments provided as colorant particles have difficulty permeating through the ink permeable layer 113 described above, so that the pigments can accumulate in the ink permeable layer 113.

As a result, the absorbed content of colored component in the ink receptive layer 112 becomes low, so that the printing density of the image (reflective image) observed from the surface of the substrate 110 becomes low.

In addition, the recording sheet 110 described in the Japanese Patent Laid-Open Publication No. Sho. 62-280068 includes a hydrophobic organic filler in the ink permeable layer 113. Such an organic filler is commonly expensive in comparison with inorganic one, so that the cost of the recording sheet 110 rises as a whole.

Another prior art system uses low-priced silica instead of a hydrophobic organic filler. The surface of the silica is covered with hydrophilic groups (which are similar to silanol groups), so that the silica has a high affinity for water-based ink. Therefore, if silica is added to the ink permeable layer 113, the water-based ink penetrates not only vertically (depth direction) but also laterally in the ink permeable layer 113. As a result, the ink is diffused broadly in the ink permeable layer 113. When the ink is diffused broadly, different ink droplets 114 may be mixed together in the ink permeable layer 113. As a result, neighboring dots 117 of a printed image are overlapped. Thus, the overlapped portion can be observed as a smear (banding) on a printed image.

SUMMARY OF THE INVENTION

The present invention relates to providing a method of manufacturing a recording sheet that shows a high print density observed from the substrate's side and a high-definition image quality for both pigment ink and dye ink. In addition, such a recording sheet can be commercially provided at a low price.

In one aspect, the present invention comprises an ink receptive layer for retaining ink; and an ink permeable layer placed on a surface of the ink receptive layer, through which the ink permeates to the ink receptive layer. The ink permeable layer comprises a nonionic surfactant and a water-insoluble component including an inorganic filler and a binder.

In one aspect, in the recording sheet, the water-insoluble component comprises the inorganic filler and the binder, and from 3 to 30 parts by weight of the nonionic surfactant is added to 30 parts by weight of the water-insoluble component.

In one aspect, in the recording sheet, the nonionic surfactant is an amine compound.

In one aspect of the present invention, the amine component may have at least one ether linkage in its structure.

In one aspect of the present invention, the inorganic filler may be made of silica.

In one aspect of the present invention, the binder may include a polyester resin as a main component.

In one aspect of the present invention, the ink receptive layer may include a chemical compound having at least one cationic group in its structure.

In one aspect of the present invention, the chemical compound having the cationic group may be a resin having at least one cationic group in its structure.

In one aspect of the present invention, the ink receptive layer may further include a hydrophilic resin which is different from the chemical compound having the cationic group.

BRIEF DESCRIPTION OF THE DRAWINGS

FIG. 1(*b*) is a cross sectional diagram in accordance with one embodiment of the present invention illustrating the steps of manufacturing the recording sheet of the present invention;

FIG. 1(*c*) is a cross sectional diagram in accordance with one embodiment of the present invention illustrating the steps of manufacturing the recording sheet of the present invention;

FIG. 6(*b*) is a cross sectional diagram illustrating a conventional recording sheet.

DETAILED DESCRIPTION OF THE PREFERRED EMBODIMENTS

In general the present invention relates to recording sheets and methods for making recording sheets. In a first embodiment, 6 parts by weight of a hydrophilic resin (polyvinyl pyrrolidone: sold under the name "Luviskol K-90" by BASF Co., Ltd.), 3 parts by weight of aluminum hydroxide (sold under the name "H42" by Showa Denko), and 51 parts by weight of ion exchanged water were added to 40 parts by weight of a resin having cationic groups (a denatured urethane: sold under the name "IJ60" by Dainippon Ink and Chemicals, Inc., solid content: 15%) such that the hydrophilic resin was different from the resin having cationic groups. Then, the mixture was stirred for 3 hours in a jar mill to obtain a painting solution for the ink receptive layer.

Figure 1A:
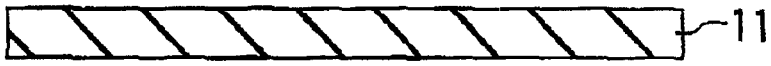
FIG. 1(*a*), is a cross sectional diagram in accordance with one embodiment of the present invention illustrating the steps of manufacturing the recording sheet of the present invention.
Figure 1B:
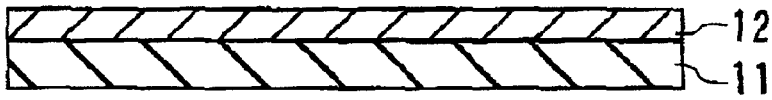
Figure 1C:
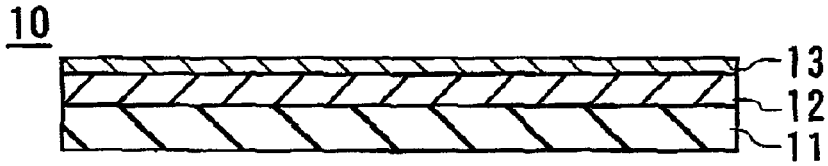

Referring now to FIG. 1(*a*), reference numeral 11 denotes a transparent substrate made of a polyethylene terephthalate resin (sold under the name "Cosmoshine A4100" by Toyobo Co., Ltd., 100 μm in thickness, one side thereof processed into a glueable layer). The painting solution for the ink receptive layer prepared by the above step was applied on the surface of the substrate 11 by a bar coater. Subsequently, it was dried at a temperature of 120° C. for 3 minutes by a hot-air convection oven, resulting in an ink receptive layer 12 (FIG. 1(*b*)). In this embodiment, the ink receptive layer 12 was formed so as to have a thickness of 13 μm after drying.

Next, a solvent was prepared by mixing 56 parts by weight of methylethylketone with 14 parts by weight of cyclohexane. While stirring the solvent by a disolver, 15 parts by weight of a water-insoluble polyester resin (sold under the name "VYLON 200" by Toyobo Co., Ltd.) as a binder (in this invention, a water-insoluble resin is used as the binder) was added to the solvent. After keeping on stirring for 2 hours, a resin solution in which the polyester resin was dissolved in the solvent was obtained.

15 parts by weight of silica (sold under the name "Mizukasil P527" by Mizusawa Industrial Chemicals Co., Ltd.), 1.6 μm in average particle size) as an inorganic filler and 10 parts by weight of polyoxyethylene (hereinafter, referred to as POE) oleylamine (sold under the name "TAMNO-5" by Nikko Chemicals Co., Ltd.) as a nonionic surfactant made of an amine chemical compound were added to the resin solution to obtain a mixture. Then, the mixture was stirred for 1 hour, resulting in a painting solution for the ink permeable layer.

Next, the above painting solution for the ink permeable layer was applied on the surface of the ink receptive layer 12 in the state shown in FIG. 1(*b*) by a wire bar. Subsequently, the whole was dried at a temperature of 120° C. for 3 minutes by a hot-air convection oven to form an ink permeable layer 13 on the ink receptive layer 12 (FIG. 1(*c*)). In this case, the ink permeable layer 13 was formed so as to be 12 μm in thickness after drying.

In FIG. 1(*c*), therefore, reference numeral 10 denotes a recording sheet of the present invention in which the ink permeable layer 13 was formed on the ink receptive layer 12.

Using an ink jet printer (sold under the name "FJ-40" by Rolland Co., Ltd.) filled with pigment ink, predetermined images (eight patterns of portraits) were printed on the surface of the ink permeable layer 13 of the recording sheet 10 prepared by the above steps.

Using the recording sheet 10 on which those images were printed, each of evaluation tests for evaluating "print density" and "transparent-image banding" of the printed images. The results of the evaluation tests were listed as Example 1 in Table 1 below.

[Print Density]

Regarding the above printed image, the image (reflective image) was visually observed from the other side of the substrate 11 with respect to the ink receptive layer 12 and the ink permeable layer 13. In this case, the observation was performed at a distance of 30 cm from the recording sheet 10.

The results of the observation were listed in Table 1 below, where "○" indicated that the color density of the printed image was high and "X" indicated that the color density of the printed image was low.

[Transparent-image Banding]

The presence or absence of smear (banding) in the image (transparent image) was visually observed from the other side of the recording sheet 10 with respect to the ink receptive layer 12 and the ink permeable layer 13 when the surface of the recording sheet 10 on which the ink permeable layer 13 was formed was placed next to a light source. In this case, the observation was performed at different distances from the recording sheet 10. The results were listed in Table 1 below and indicated as follows. That is, "○" represents that there was no smear observed even though the distance was less than 30 cm; "Δ" represents that there is a smear observed when the distance was less than 30 cm, while there is no smear observed when the distance was 30 cm or more but less than 1 m; and "X" represents that there is a smear observed when the distance was less than 1 m, while there is no smear observed when the distance was 1 m or more.

TABLE 1

| | Type | Surfactant | Composition | Evaluation test: Print density | Evaluation test: Transparent image banding |
|---|---|---|---|---|---|
| Example 1 | Nonionic | TAMNO-5 | POE(5) Oleylamine | ○ | ○ |
| Example 2 | Nonionic | TAMNO-15 | POE(15)Oleylamine | ○ | ○ |
| Example 3 | Nonionic | TAMNS-5 | POE(5) Stearylamine | ○ | ○ |
| Example 4 | Nonionic | TAMNS-10 | POE(10) Stearylamine | ○ | ○ |
| Example 5 | Nonionic | TAMNS-8 | POE(8) Stearylpropylene diamine | ○ | ○ |
| Example 6 | Nonionic | TB128 | POE(2) Lauryl aminoether | ○ | ○ |
| Example 7 | Nonionic | Zondes AL-10 | POE(10) Lauryl aminoether | ○ | ○ |
| Comparative Example 1 | Anionic | Persoft SFT | Alkylether surphate TEA salt | ○ | x |
| Comparatve Example 2 | Anionic | Homogenol L95 | polycarboxilic acid | x | ○ |
| Comparative Example 3 | Cationic | Cation AB | Octadecyltrimethyl ammonium chloride | x | ○ |
| Comparative Example 4 | Cationic | Cation F2-35R | Alkyldimethyl benzyl ammonium chloride | x | ○ |
| Comparative Example 5 | — | None | — | ○ | x |

*In the table, "POE" means polyoxyethylene, and the numeral in the parentheses is the number of the POE in one molecule.

Examples 2 to 7

Six different painting solutions to be provided as their respective ink permeable layers were prepared by the same steps as those of Example 1 except that six different nonionic surfactants were used respectively instead of the surfactant used in Example 1. That is, each surfactant was mixed with the same resin solution and the same inorganic filler as those of Example 1 at the same weight ratio as that of Example 1.

Each of six different painting solutions for the ink permeable layer was applied on the ink receptive layer 12 in the state shown in FIG. 1(*b*) by the same steps as described in Example 1. Then, it was dried to form an ink permeable layer 13. Consequently, the recording sheets 10 of Examples 2 to 7 were obtained, respectively.

In each of Examples 2 to 4, the nonionic surfactant used included an amine compound as a main component. In Example 2, POE(15) oleylamine (sold under the name "TAMNO-15" by Nikko Chemicals Co., Ltd.) was used as a nonionic surfactant. In Example 3, POE(5) stearylamine (sold under the name "TAMNS-5" (by Nikko Chemicals Co., Ltd.) was used as a nonionic surfactant. In Example 4, furthermore, POE(10) stearylamine (sold under the name "TAMNS-10" by Nikko Chemicals Co., Ltd.) was used as a nonionic surfactant.

In Example 5, a diamine compound, POE(8) stearylpropylene diamine (sold under the name "TAMNS-8" by Nikko Chemicals Co., Ltd.) was used as a nonionic surfactant. In Example 6, POE(2) lauryl aminoether (sold under the name "TB128" by Matsumoto Yushi-Seiyaku Co., Ltd.), an amine compound having an ether linkage, was used as a nonionic surfactant. In Example 7, a POE(10) lauryl aminoether (sold under the name "Zondes AL-10" by Matsumoto Yushi-Seiyaku Co., Ltd.), another amine compound having ether linkages, was used as a nonionic surfactant.

An image was printed on a recording sheet 10 of each of Examples 2 to 7 by the same steps as those of Example 1. In addition, each of evaluation tests for evaluating "print density" and "transparent-image banding" properties was performed on the resulting image under the same conditions as those of Example 1. The obtained evaluation results were listed in Table 1 described above.

Comparative Examples 1 to 4

Four different painting solutions for their respective ink permeable layers were prepared in substantially the same way as those of Example 1 except that three different anionic or cationic surfactants listed in Table 1 described above were used respectively instead of the surfactant used in Example 1. That is, each surfactant was mixed with the same resin solution and the same inorganic filler as those of Example 1 at the same ratio by weight as that of Example 1.

Each of four different painting solutions described above was applied on the ink receptive layer in the state shown in FIG. 1(*b*) in substantially the same way as that of Example 1. Then, it was dried to form an ink permeable layer. Consequently, the recording sheets of Comparative Examples 1 to 4 were obtained, respectively.

The following surfactants were used in Comparative Examples 1 to 4, respectively. In Comparative Example 1, an anionic surfactant, alkylether surphate TEA salt (sold under the name "PERSOFT SFT" by Nippon Yushi Co., Ltd.), was used. In Comparative Example 2, an anionic surfactant, polycarboxylic acid (sold under the name "HOMOGENOL L95" by Kao Co., Ltd.) was used as a surfactant. In Comparative Example 3, a cationic surfactant, octadecyltrimethyl ammonium chloride (sold under the name "Cation AB" by Nippon Yushi Co., Ltd.), was used as a surfactant. In Comparative Example 4, a cationic surfactant, alkyldimethyl benzyl ammonium chloride (sold under the name "Cation F2–35R" by Nippon Yushi Co., Ltd.), was used as a surfactant.

Comparative Example 5

A painting solution for an ink permeable layer including no surfactant was prepared by the same steps as those of Example 1. That is, 15 parts by weight of inorganic filler was added to 85 parts by weight of the resin solution prepared in substantially the same way as that of Example 1.

Then, a recording sheet of Comparative Example 5 was obtained by applying the painting solution on the surface of the ink receptive layer in substantially the same way as that of Example 1, followed by drying the applied solution to form an ink permeable layer containing no surfactant.

An image was printed on the recording sheet of each of Comparative Examples 1 to 5 by the same steps as those of Example 1. In addition, each of evaluation tests for evaluating "print density" and "transparent-image banding" was performed on the resulting image under the same conditions as those of Example 1. The obtained evaluation results were listed in Table 1 described above.

As is evident from Table 1 described above, the recording sheets of Examples 1 to 7 were evaluated as excellent with respect to their "transparent-image banding" and "printing density" properties. The recording sheets of Comparative Examples 1 and 5 were evaluated as excellent with respect to their "printing density" properties but smears were observed on the printed images (transparent images) thereon.

Furthermore, low printing density was observed on the substrate 11 in each of Comparative Examples 2 to 4. In this case, the observed transparent image became blurred due to lack of ink.

EXAMPLES

Examples 8 to 12

Five different painting solutions for their respective ink permeable layers were prepared by the same steps as those of Example 1. That is, 15 parts by weight of the same binder as that of Example 1 and 15 parts by weight of the same inorganic filler as that of Example 1 were added to 70 parts by weight of the same solvent as that of Example 1, followed by the addition of the same surfactant, POE(2) lauryl aminoether, as that of Example 6 at a concentration of 3 to 30 parts by weight as represented in Table 2 below.

Each of these painting solutions were applied on the surface of the ink receptive layer 12 and then dried to form an ink permeable layer 13 and obtain a recording sheet 10 of each of Examples 8 to 12.

Test samples were prepared by printing images on these recording sheets 10, respectively, under the same conditions as those of Example 1. Then, the samples were subjected to the tests of evaluating the properties of "transparent-image banding" and "adhesion of coating" as described below and the evaluation results were listed in Table 2 below.

[Test for Adhesion of Coating]

An image was printed on the surface of the recording sheet 10 under the same conditions as those of Example 1. Subsequently, an adhesive surface of a transparent adhesive tape was pasted on the printed surface (ink applied portion) of the ink permeable layer 13, followed by peeling the tape from the recording sheet 10.

The adhesion of coating on the recording sheet was evaluated as excellent "○" when the ink permeable layer 13 remained substantially the same before and after the removal of the adhesive tape (i.e., the ink permeable layer 13 was not transferred to the transparent adhesive tape after the peeling). On the other hand, the adhesion of coating on the recording sheet was evaluated as poor "X" when the ink permeable layer 13 was attached on the transparent adhesive tape at the time of peeling the transparent adhesive tape from the recording sheet 10.

TABLE 2

| | Evaluation Test | | |
|---|---|---|---|
| | Added amount (Parts by weight) | Transparent-image banding | Adhesion of Coating |
| Comparative Example 6 | 0.5 | x | ○ |
| Comparative Example 7 | 1.0 | x | ○ |
| Example 8 | 3.0 | ○ | ○ |
| Example 9 | 5.0 | ○ | ○ |
| Example 10 | 10.0 | ○ | ○ |
| Example 11 | 20.0 | ○ | ○ |
| Example 12 | 30.0 | ○ | Δ |
| Comparative Example 8 | 40.0 | x | x |

*The "added amount" in the above table is the amount of the surfactant added with respect to 30 parts by weight of water-insoluble components (inorganic filler and a water-insoluble resin).

Comparative Examples 6, 7, and 8

Five different painting solutions for their respective ink permeable layers were prepared by the same steps as those of Example 1. That is, 15 parts by weight of the same binder as that of Example 1 and 15 parts by weight of the same inorganic filler as that of Example 1 were added to 70 parts by weight of the same solvent, as that of Example 1, followed by the addition of the same surfactant, POE(2) lauryl aminoether as that of Example 6 at a concentration of less than 3 parts by weight or more than 30 parts by weight as represented in Table 2 above.

Each of these painting solutions was applied on the surface of the ink receptive layer in the state of FIG. 1(*b*) by the same steps as those of Example 1 and then dried to form an ink permeable layer and obtain a recording sheet of each of Comparative Examples 6, 7, and 8.

A printed image was formed on each of the recording sheets of Comparative Examples 6, 7, and 8 under the same conditions as those of Example 1, followed by the tests of evaluating the properties of "transparent-image banding" and "adhesion of coating" under the same conditions as those of Examples 8 to 12. The evaluation results were listed in Table 2 above.

As indicated in Table 2 described above, each of Examples 8 to 12, in which the added amount of nonionic surfactant was in the range of 3 parts by weight both inclusive to 30 parts by weight with respect to 30 parts by weight of water-insoluble component consisting of the inorganic filler and the binder, showed excellent results in "transparent image banding" property compared with that of any of Comparative Examples 6, 7, and 8.

In particular, each of Examples 8 to 11, in which the added amount of nonionic surfactant was in the range of 3 parts by weight both inclusive to 20 parts by weight with respect to 30 parts by weight of the water-insoluble component, also showed excellent results in "adhesion of coating" property compared with that of any of Comparative Examples 6, 7, and 8.

An image was printed on the surface of the ink permeable layer 13 of the recording sheet 10 of each of Example 7 and Comparative Example 5 described above using three different pigment inks. Then, the diameter of each dot formed on the recording sheet 10 was observed from the surface of the ink permeable layer 13 (i.e., observed from the printing side). Also, the dot diameter was observed from the other side of the substrate 11 with respect to the ink receptive layer 12 and the ink permeable layer 13 (i.e., observed from the observing side).

Figure 2:
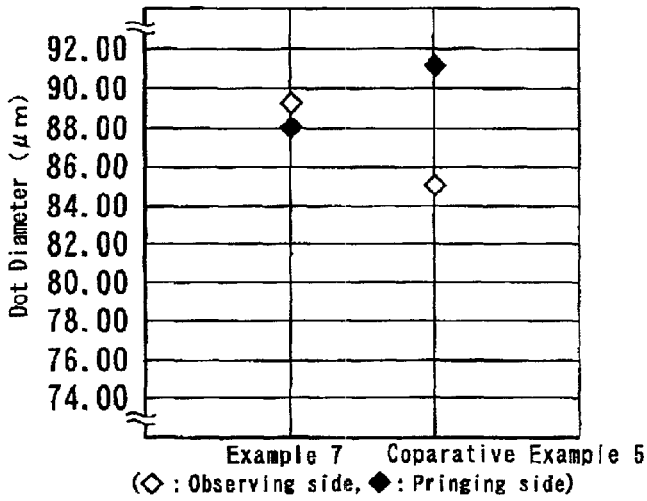
FIG. 2 is a graph illustrating the states of dots when yellow ink is used in accordance with one embodiment of the present invention.
Figure 3:
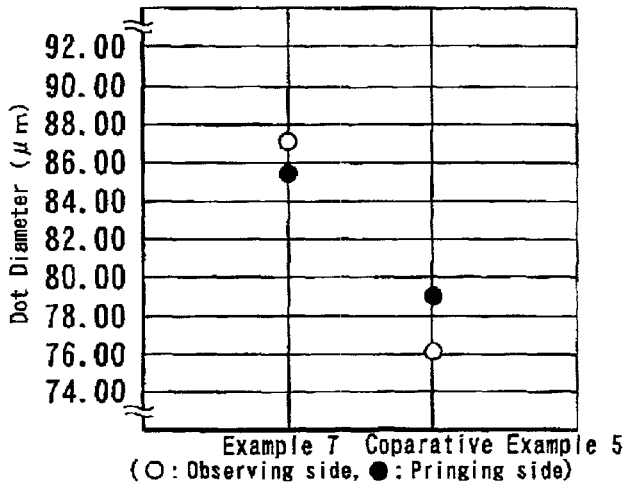
FIG. 3 is a graph illustrating the states of dots when cyan ink is used in accordance with one embodiment of the present invention.
Figure 4:
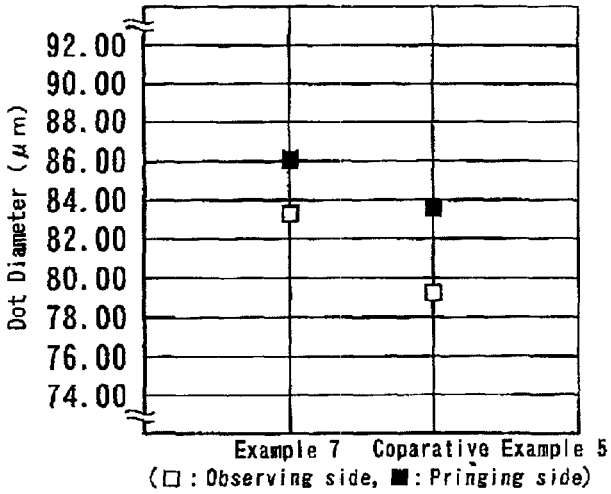
FIG. 4 is a graph illustrating the states of dots when magenta ink is used in accordance with one embodiment of the present invention.

FIGS. 2, 3, and 4 are graphs that represent the diameters of dots formed by yellow, cyan, and magenta pigment inks, respectively. In each graph, the vertical axis represents the dot diameters of Example 7 and Comparative Example 5 indicated on the horizontal axis.

Regarding the dots of the printed image formed on the recording sheet 10 of Example 7, as is evident from each of graphs of FIGS. 2 to 4, the dot diameters observed from both sides (i.e., the observing side and the printing side) were closely approximate to each other, compared with the dots formed on the recording sheet of Comparative Example 5. Consequently, it became evident that the ink placed on the ink permeable layer 13 moved directly through the ink permeable layer 13 and the ink receptive layer 12 in a depth direction without laterally dispersing through these layers.

In general, the pigments to be used as colorants exist as dispersed particles in the ink. Thus, the pigment ink penetrates vertically through the layer slower than the dye ink, so that the ink is facilitated to be dispersed in a lateral direction. According to the present invention, however, the ink permeable layer is constructed to prevent ink from the lateral dispersion therethrough, so that there is no smear in a printed image even if the image is printed using the pigment ink.

EXAMPLES

Examples 13 to 19

Additional examples of the recording sheet 10 in accordance with the present invention will be described below.

First, an aqueous solution of water-soluble resin different from those of Examples 1 to 12 is used to prepare a painting solution for an ink receptive layer 12. In the present examples, a water-soluble denatured urethane resin (sold under the name "IJ50" by Dainippon Ink And Chemicals, Inc.) having cationic groups was used. Then, the painting solution for the ink receptive layer 12 was applied on the surface of the substrate 11 in the state shown in FIG. 1(*a*) by the same step as that of Example 1 and dried, resulting in the ink receptive layer 12.

Furthermore, the same painting solution for the ink permeable layer 13 as that of Example 1 was applied on the surface of the ink receptive layer 12 and dried to form an ink permeable layer 13. Consequently, a recording sheet 10 of Example 13 was obtained.

Alternatively, each of six different painting solutions for their respective ink receptive layers was prepared using one of the following six different resins instead of the denatured urethane resin. That is, the resin was selected from: denatured polyvinyl alcohol (sold under the name "CM318" by Kuraray Co., Ltd.); acrylic copolymer (sold under the name "IJAP480" by Osaka Organic Chemical Industry Ltd.); water-soluble polyester (sold under the name "NS122L" by Takamatsu Yushi Co., Ltd.); polyvinyl alcohol having a saponification value of 99 (sold under the name "PVA117" by Kuraray Co., Ltd.); denatured polyvinyl alcohol (sold under the name "KM118" by Kuraray Co., Ltd.); and water-soluble polyester (sold under the name "NS300L" by Takamatsu Yushi Co., Ltd.).

The ink receptive layer 12 was formed on the surface of the substrate 11 in substantially the same way as those of Example 13 described above through any of the painting solutions for the ink receptive layer described above. Subsequently, the same ink permeable layer 13 as that of Example 1 was formed on the surface of the ink receptive layer 12, resulting in a recording sheet 10 of each of Examples 14 to 19.

Each of test samples was prepared by forming a printed image using the recording sheet 10 of one of Examples 13 to 19 under the same conditions as those of Example 1. Then, the test samples were subjected to the following tests for evaluating the properties of "transparent-image banding", "reflective-image banding", and "overall estimation of banding".

[Transparent-image Banding]

The recording sheet 10 was arranged to face the surface thereof on which the ink permeable layer 13 was formed toward a light source. Then, the presence or absence of smear (banding) on the image (transparent image) was visually observed from the other side of the recording sheet 10 with respect of the ink receptive layer 12 and the ink permeable layer 13.

Here, the observations were performed by shifting the distance from the recording sheet 10 to the observation point. The recording sheet 10 was evaluated as excellent "○" when the smear was not observed at the distance of less than 30 cm. The recording sheet 10 was evaluated as fair "Δ" when the smear was observed at the distance of less than 30 cm but not observed at the distance of 30 cm or more and less than 1 m. The recording sheet 10 was evaluated as poor "X" when the smear was observed at the distance of less than 1 m but not observed at the distance of 1 m or more. The results were listed in Table 3 below.

[Reflective-image Banding]

Under the interior light, an image printed on each of the test samples was visually observed from the other side of the recording sheet 10 with respect to the ink receptive layer 12 and the ink permeable layer 13 to determine the presence or absence of smear of the image (reflective image) to be observed by the reflection of light. In this case, the observations were performed at a distance of 30 cm from the recording sheet 10.

The recording sheet 10 was evaluated as excellent "○" when there was no smear observed on the reflective image. On the other hand, the recording sheet 10 was evaluated as poor "X" when there was a smear observed on the reflective image. The results were listed in Table 3 below.

TABLE 3

Used resin for ink receptive layer and evaluation test of each of recording sheets

| | Type | Trade Name | Conmponent | Reflective-image banding | Transparent-image banding |
|---|---|---|---|---|---|
| Example 13 | Cationic | IJ50 | Denatured urethane | ○ | ○ |
| Example 14 | Cationic | CM318 | Denatured polyvinyl alcohol | ○ | ○ |
| Example 15 | Cationic | IJAP480 | Acrylic copolymer | ○ | ○ |
| Example 16 | Anionic | NS122L | Polyester | x | Δ |
| Example 17 | Nonionic | PVA117 | Polyvinyl alcohol (saponification value of 99) | x | Δ |

TABLE 3-continued

Used resin for ink receptive layer and evaluation test of each of recording sheets

| | Type | Trade Name | Conmponent | Reflective-image banding | Transparent-image banding |
|---|---|---|---|---|---|
| Example 18 | Anionic | KM118 | Denatured polyvinyl alcohol | x | Δ |
| Example 19 | Anionic | NS300L | Polyester | x | Δ |
| Comparative Example 9 | Anionic | NS122L | Polyester | x | x |

*The presence or absence of banding in each of the reflective image and transparent image in case of using component (resin) for the ink receptive layer listed in Table 3 above. Incidentally, the ink permeable layers of Examples 13–19 and Comparative Example 9 were the same as those of Example 1 and Comparative Example 5, respectively.

Comparative Example 9

An ink receptive layer was formed on the substrate using the same painting solution for the ink receptive layer as that of Example 16. Subsequently, an ink permeable layer was formed on the ink receptive layer by the same steps as those of Example 1 using the same painting solution for the ink permeable layer as that of Comparative Example 5 in which the surfactant was not included. As a result, a recording sheet of Comparative Example 9 was obtained.

A test sample was prepared by forming a printed image on the recording sheet under the same conditions as those of Example 1. Then, the test sample was subjected to each of the tests for evaluating "transparent-image banding" and "reflective-image banding" under the same conditions as those of Examples 13 to 19. The evaluation results were listed in Table 3 below.

The cationic resin can be defined as one having cationic groups in the chemical compound and having positive charges (poly-cations) in an aqueous solution. Also, the anionic resin can be defined as one having an anionic group in the chemical compound and having negative charges (poly anions) in an aqueous solution. Furthermore, the nonionic resin can be defined as one having no charge in an aqueous solution. Therefore, the denatured urethane resin used in Example 13, the denatured polyvinyl alcohol used in Example 14, and the acrylic copolymer used in Example 15 can be included in cationic resins. The polyester used in Example 16 and the polyvinyl alcohol used in Example 17 can be included in nonionic resins. The denatured polyvinyl alcohol used in Example 18, and the polyester used in Example 19 can be included in anionic resins.

As is evident from Table 3 described above, the cationic resin was used in the ink receptive layer 12 in each of Examples 13 to 15, so that there were no banding observed in both the reflective image and the transparent image and the excellent results were obtained compared with those of Examples 16 to 19 and Comparative example 9 using anionic or nonionic resins.

Regarding each of Examples 13 to 15 using the cationic resins, it is assumed that the fixing property of an ink coloring component in the ink receptive layer 12 is improved as the cationic resin may also act as a fixing agent that fixes the ink coloring agent.

Accordingly, it has been shown that a printed image of higher quality can be obtained by the recording sheet 10 that includes the ink permeable layer 13 including large amount of the amine-based nonionic surfactant and the ink receptive layer 12 including the cationic resin because any smear can be hardly generated in both layers 12, 13.

In the above description, the recording sheet having polyethylene terephthalate as the substrate 11 has been explained. The present invention, however, is not limited thereto.

Examples of the materials adaptable to the substrate 11 include polyester such as polyethylene naphthalate, polyolefin such as polyethylene and polypropylene, polyvinyl chloride, polystyrene, polymethyl methacrylate, polycarbonate, transparent paper, cellulose acetate, polyacrylate, and polyether sulfone.

Especially, in the case of the recording sheet for overhead projector (OHP), polyethylene terephthalate, hard polyvinyl chloride, polypropylene, triacetate, or the like may be preferably used as a material of the substrate 11.

The thickness of the substrate 11 is also not limited to a specific one. In general, however, it may preferably be in the range of 50 $\mu$m to 200 $\mu$m both inclusive.

If the ink receptive layer is adequately solid, there is no need to use the substrate in particular.

Figure 5:
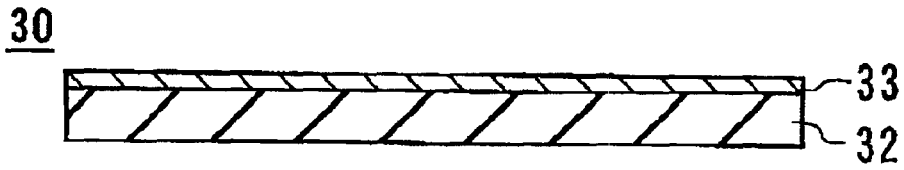
FIG. 5 is a cross sectional diagram illustrating the recording sheet in accordance with another embodiment of the present invention.
Figure 6A:
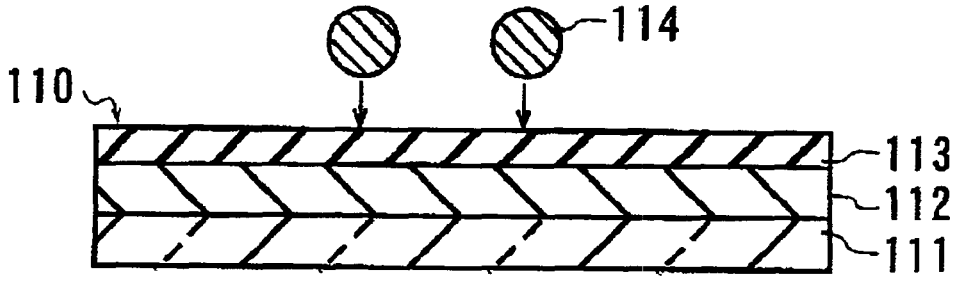
Fig. 6a PRIOR ART
FIG. 6(*a*) is a cross sectional diagram illustrating a conventional recording sheet.
Figure 6B:
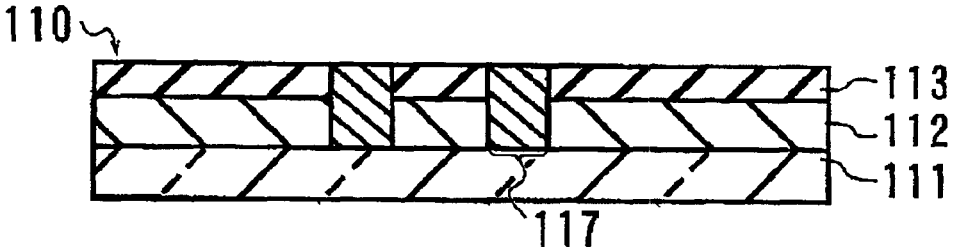
Fig. 6b PRIOR ART

Referring now to FIG. 5, for example, reference numeral 30 denotes a recording sheet as another example of the present invention. In the figure, the recording sheet 30 has an ink receptive layer 32 and an ink transparent layer 33 formed on the ink receptive layer 32. In this recording sheet 30, the ink receptive layer 32 is adequately solid and, thus, there is no need to use any substrate.

In Examples 1 to 19, furthermore, silica was used as the inorganic filler to be added to the ink permeable layer 13. The present invention, however, is not limited to a specific component. It is also possible to use alumina sol, pseudo boehmite sol, talc, kaolin, clay, zinc oxide, tin oxide, aluminum oxide, aluminum hydroxide, calcium carbonate, titanium white, barium sulfate, titanium dioxide, aluminum silicate, magnesium silicate, magnesium oxide, smectite, zeolite, diatomite, or the like.

Furthermore, another resin such as polyurethane, polyacryl, phenoxy, or SIS resin may be used instead of using the inorganic filler described above.

The water-insoluble component to be used in the ink permeable layer is not limited to the one consisting of the binder and the inorganic filler. The water-insoluble component of the present invention may include other water-insoluble components.

Furthermore, the main component of the binder resin to be used in the ink permeable layer 13 is not limited to polyester but also possible to use polyethylene, polystyrene, polymethacrylate, elastomer, ethylene-vinyl acetate copolymer, styrene-acrylic acid copolymer, polyacryl, polyvinylether, polyamide, polyolephane, polysilicon, guanamine, polytetrafluoroethylene, or the like.

Furthermore, the resin to be used as the ink receptive layer 12 of the recording sheet 10 in accordance with the present invention may be any hydrophilic resin.

For providing a high ink absorbency to the ink receptive layer 12, it is preferable to use a water-soluble or hydrophilic resin having the property of increasing its volume by absorbing water. The water-soluble or hydrophilic resins include albumin, gelatin, casein, starch, gum arabic, sodium alginate, carboxymethyl cellulose, hydroxyethyl cellulose, polyamide, polyethylene, polyvinyl pyrrolidone, polyvinyl alcohol, polyvinyl acetal, melanin, polyester, polyacryl, polyurethane, and polyallyl amine or the like.

The chemical compounds having cationic groups to be used in the present invention are not limited to the resins. It is also possible to use, for example, a cationic surfactant and a filler in which cationic groups are exposed on the surface of the particle.

Furthermore, the painting solutions for the ink permeable layer 13 and the ink receptive layer 12 can be applied using various coating devices such as a blade coater and gravure coater in addition to the wire bar and the bar coater.

Furthermore, in the recording sheet 10 of the present invention, the excellent printing results can be obtained especially using pigment ink. According to present invention, however, it is not limited to such a type of ink. The recording sheet of the present invention allows a printed image having an excellent printing quality by the use of dye ink instead of pigment ink.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A recording sheet comprising:

a substrate;

an ink receptive layer placed on the substrate for retaining ink; and an ink permeable layer placed on a surface of the ink receptive layer, through which the ink permeates to the ink receptive layer, the ink permeable layer comprising a nonionic surfactant and a water-insoluble component including an inorganic filler and a binder;

wherein the inorganic filler is silica, and the nonionic surfactant is an amine compound; and the binder includes a polyester resin as a main component by weight.

2. The recording sheet according to claim 1, wherein the water-insoluble component comprises the inorganic filler and the binder, and from 3 to 30 parts by weight of the nonionic surfactant is added to 30 parts by weight of the water-insoluble component.

3. The recording sheet according to claim 1, wherein the amine component has at least one ether linkage in its structure.

4. The recording sheet according to claim 1, wherein the ink receptive layer comprises a chemical compound having at least one cationic group in its structure.

5. The recording sheet according to claim 4, wherein the chemical compound having the cationic group is a resin having at least one cationic group in its structure.

6. The recording sheet according to claim 5, wherein the ink receptive layer further comprises a hydrophilic resin which is different from the chemical compound having the cationic group.

7. The recording sheet according to claim 4, wherein the ink receptive layer further comprises a hydrophilic resin which is different from the chemical compound having the cationic group.

8. The recording sheet according to claim 4, wherein the chemical compound having at least one cationic group in its structure is water-soluble.

* * * * *